United States Patent [19]

Seitzinger et al.

[11] 4,334,489

[45] Jun. 15, 1982

[54] REVERSING MECHANISM FOR STEERABLE PROPELLERS, JET RUDDERS OR OTHER DRIVE MECHANISMS OF SHIPS

[75] Inventors: Kurt Seitzinger, Koblenz-Karthause; Siegfried Lais, Spay, both of Fed. Rep. of Germany

[73] Assignee: Schottel-Werft Josef Becker GmbH & Co., KG, Spay, Fed. Rep. of Germany

[21] Appl. No.: 36,543

[22] Filed: May 7, 1979

Related U.S. Application Data

[63] Continuation of Ser. No. 826,055, Aug. 19, 1977, abandoned.

[30] Foreign Application Priority Data

Aug. 19, 1976 [DE] Fed. Rep. of Germany ..... 2637345

[51] Int. Cl.[3] ..... B63H 25/42

[52] U.S. Cl. ..... 114/144 R; 114/144 E; 114/150; 440/53; 440/61

[58] Field of Search ..... 114/150, 144 E, 144 R; 440/61, 54, 53

[56] References Cited

U.S. PATENT DOCUMENTS

| | | | |
|---|---|---|---|
| 2,892,310 | 6/1959 | Mercier | 114/150 X |
| 3,483,843 | 12/1969 | Hawthorne | 440/54 |
| 3,488,954 | 1/1970 | Thomas et al. | 114/150 X |
| 3,527,186 | 9/1970 | Wennberg | 114/144 RE |
| 3,888,083 | 6/1975 | Tone | 114/150 X |
| 3,976,023 | 8/1976 | Noguchi et al. | 114/144 E |
| 4,088,087 | 5/1978 | Nitta | 114/144 R |

*Primary Examiner*—Sherman D. Basinger

*Attorney, Agent, or Firm*—Blanchard, Flynn, Thiel, Boutell & Tanis

[57] ABSTRACT

A reversing mechanism for steerable propellers on ships wherein the direction of travel of the ship is controlled by the position of the steerable propeller. A selector switch is provided for controlling the direction of travel as well as directions forward and rearward such that when the direction of travel is to be reversed, the steerable propeller will be sequentially disengaged from the propeller driving mechanism and automatically pivoted through 180° to effect a reverse operation without altering the position of the steering control. In other words, the position of the steerable propeller will be altered without altering the position of the steering control when the direction of travel of the ship is to be reversed.

11 Claims, 4 Drawing Figures

REVERSING MECHANISM FOR STEERABLE PROPELLERS, JET RUDDERS OR OTHER DRIVE MECHANISMS OF SHIPS

This is a continuation of application Ser. No. 826,055 filed Aug. 19, 1977, and now abandoned.

FIELD OF THE INVENTION

The invention relates to a reversing mechanism for steerable propellers, jet rudders or other drive mechanisms of ships in which the control action is based on a pivoting of the thrust producer, for example the propeller, about a substantially vertical axis through an angle which determines the main travelling direction (forward and backward), and having a device for the control of the direction, for example a control wheel or a control lever and a drive mechanism for effecting the said pivoting movement.

BACKGROUND OF THE INVENTION

Reversing mechanisms of this type in which the main direction of travel is changed from forward to backward with the help of a rudder unit, for example by pivoting or swiveling a steerable propeller, are known. They generally also operate satisfactorily. In spite of this, improvements are useful in particular for the personnel which is accustomed only to normal rudder units wherein a reversing of the main direction of travel is not possible. For the reversal from forward to backward and vice versa, it is necessary, for example in the known steerable propellers for the underwater part to be swung at 180° from the steering control. If the steering control is for example a hand wheel, when this must be rotated 3 to 20 times to one direction depending on the translation between the handwheel and the steerable propeller in order to achieve the desired thrust reversal. Particularly during maneuvering in narrow waters in which the ship must be shifted only for a few meters or centimeters, the steerable propeller is superior to other drive and control units, however, it requires also a certain expense in force and attention. In addition, difficulties can result during the adjustment of the steering control and rudder indication. If reversing of the main direction of travel is not done with the necessary speed, it is possible when dealing with inexperienced operators that an unintended lateral thrust, a so-called "deterioration in the direction of travel" will result.

Therefore the basic purpose of the invention is to simplify and make safe the operation of the control for steerable propellers, jet rudders or similarly acting drive mechanisms of ships.

The invention is based substantially on separating the control of the direction of travel (right, left) from the choosing of the main direction of travel (forward, backward).

The steerable propeller of the jet rudder or the other thrust producer can therewith be reversed directly at 180° from the control console with a selector switch for the main direction of travel (forward, backward) being indepenent from the remaining control.

A particularly advantageous and simple reversing mechanism results from the drive mechanism for the pivoting of the thrust producer, for example steerable propeller, for the right-left travel being combined with the drive mechanism for the reversal of the main travelling direction (forward, backward).

In order that it is also possible to change with the selector switch device for the main travelling direction also the direction of rotation between the steering control and the rudder movement and/or direction of travel indicator, the reversing mechanism is inventively further developed with the selector switch device containing a switching mechanism for the main travelling direction, with which switching mechanism the desired-actual value comparison device for forward travel which is associated with the steering control (left, right) is switched over to a different desired-actual value comparison device for backward travel or vice versa.

In order to prevent the thrust producer from producing during reversal of the direction of travel a damaging lateral thrust, the invention can be developed wherein the drive mechanism for the pivoting movement for reversing the main direction of travel (forward, backward) is designed for an accelerated pivoting movement (quick reversal), for example by a suitable valving arrangement. In order to ensure a quick reversal of the direction of travel, there exists always the necessary power reserve without having to construct the respective drive machine correspondingly large.

The invention also assures a safe operation of the entire machine installation during the reversal operation without causing the attention of the operators to be diverted from the surroundings.

Of a particular importance is the invention for ships or the like having several thrust producers, thus for example for double units with steerable propellers. Both steerable propellers are controlled synchronously from a steering control. If a reversal takes place with a selector switch for the main direction of travel, then a switching arrangement can be used which, during the change of the main direction of travel, gives directions of rotations which are opposite for both steerable propellers. This assures that also in the case of a not quite taken back speed of the drive machine the ship does not "falter" from the desired direction of travel.

The invention permits a reversal of the steerable propeller quickly and without any effort to 180° and to thus change the main direction of travel. A selector switch for the main direction of travel is provided for this purpose in the control console. If the main direction of travel is changed through this selector switch, then the steerable propeller rotates 180° independent from the remaining rudder position control and therewith reverses the thrust direction. During reversal, it is possible for the selector switch to connect for a short time a high control power to the normal one, so that a high control speed is achieved and the desired change in the direction of travel is carried out as quickly as possible. The speed and the clutch of the drive machine can now be coupled with the selector switch for the main direction of travel. During a changing of the desired direction of travel, the speed is then automatically taken back and if desired the propeller is uncoupled. The ship remains then in its desired direction of travel without causing any significant lateral thrust to occur which would be damaging. In addition, a reversal of the direction of rotation between the controlled rudder position, steerable propeller and direction of travel indication can be switched with the selector switch, thus it is possible to achieve in every main direction of travel forward or backward a clear association between the controlled rudder position, direction of travel of the ship and direction of travel indication. Since a reversal of the direction of rotation between lead and steerable propeller equals a reversing of the polarity of the desired-actual value comparison, it is now possible to use for the control simple potentiometers and bridge balance circuits. Different potentiometers are used for the forward travel and for the backward travel, of which only one section of 180° each is needed. The selector switch for forward backward travel thus does not only reverse polarity of the direction of rotation, but switches over at the same time to the potentiometer which is necessary for the desired direction of travel.

Further advantages are created by the invention. Thus it is for example possible to choose the direction of rotation for the reversal which is released by the direction of travel selector switch, so that it coincides with the direction of rotation of the vertical shaft for the drive of the steerable propeller. From this, smaller control forces are created and the control elements are protected.

Further advantages and characteristics can be taken from the following description.

BRIEF DESCRIPTION OF THE DRAWINGS

The invention will be discussed with reference to some exemplary embodiments which are shown in FIGS. 1 to 4.

In the drawings.

DETAILED DESCRIPTION

Figure 1:
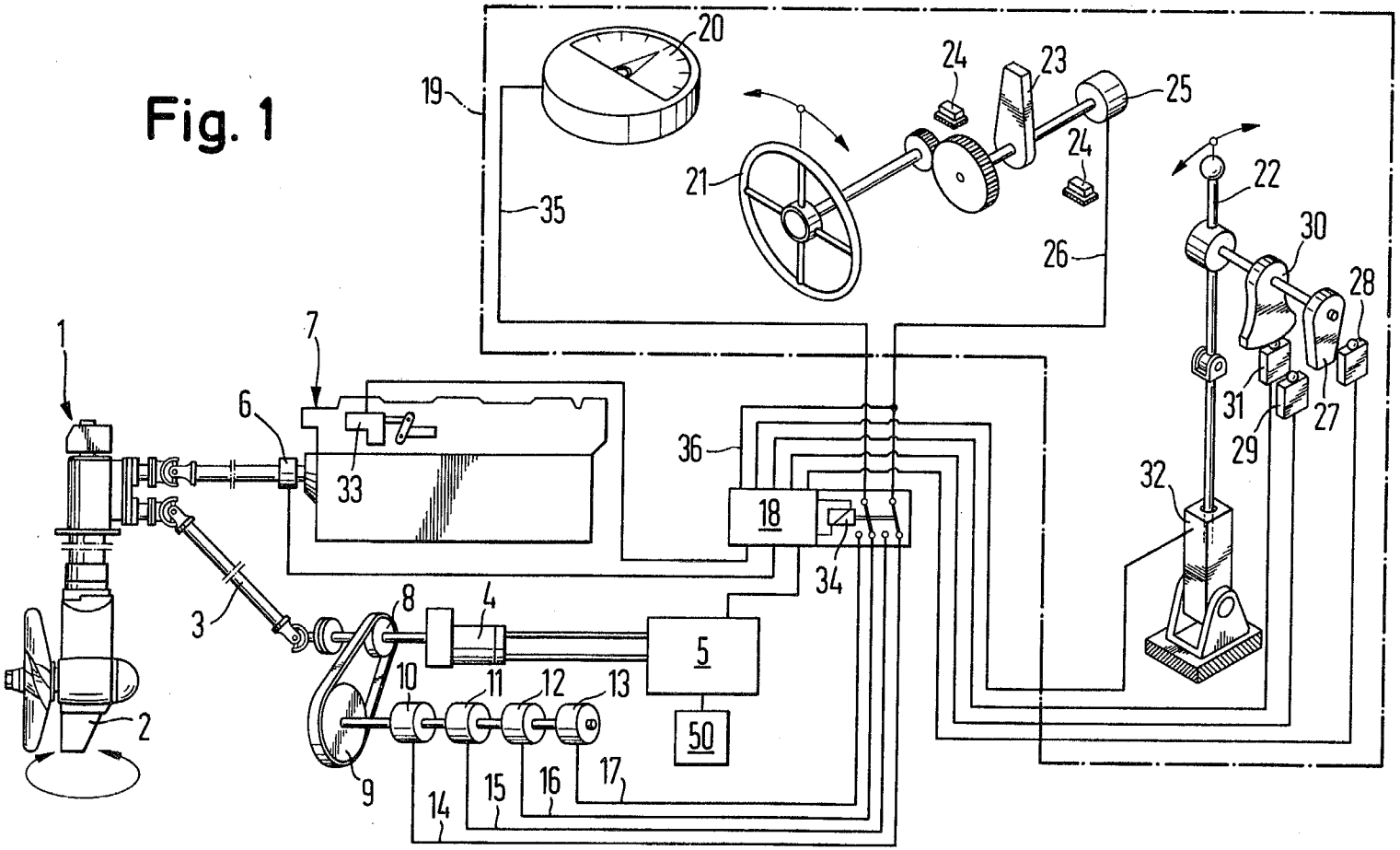
FIG. 1 schematically illustrates the drive of a steerable propeller with a reversing mechanism according to the invention.

In the exemplary embodiment according to FIG. 1, a steerable propeller 1 is controlled from a reversing mechanism which is described hereinbelow. The steerable propeller is provided with an underwater part 2 which rotatably supports the propeller and can be continuously pivoted through 360°. The steering movement is driven through a rotary control shaft 3 from a hydraulic motor 4. The hydraulic motor 4 is supplied from a hydraulic aggregate 5. The hydraulic aggregate 5 contains the means which are common herefor, like a pump, a reservoir, filter, control valves and the like, which, since they are known, are not shown and not expressely described.

A drive train mechanism effects a rotation of the propeller for the production of thrust and includes a motor 7 and a clutch 6 or other type of drive train mechanism.

The angle of tranverse of the steerable propeller is measured on the underwater part or on the hydraulic motor or therebetween by means of a torque transfer gearing arrangement 8, 9, which may be a sprocket and chain or other type of gearing and is reported by means of servos or potentiometers 10, 11, 12, 13 through lines or wires 14, 15, 16, 17 to a control device 18. Two of the servos or potentiometers 10, 11 are actual value receivers for a follower control device. The servos or potentiometers 12, 13 are used as a turn control signal for the indication of the direction of travel. An indicator 20 for the direction of travel, a hand wheel for the rudder turn control signal 21 and a selector switch lever 22 for the main direction of travel (forward, backward) are provided in the control console 19. The rudder position, namely the direction of travel, can be preset on the hand wheel 21 only at ±90°, if necessary slightly more, that is, a range of movement measured between opposite lateral sides of the vertical axis limited by lines extending transversely of the longitudinal axis of the watercraft and intersecting the vertical axis. The turn control signal is limited by turn control signal cams 23 and the stops 24. The preset direction of travel is reported by a proportional displacement-to-signal transducer; for example, servo or potentiometer 25 (reference element), to the control device 18 through the line 26.

The main direction of travel (forward, backward) of the ship can be preselected with the selector switch lever 22 by urging this selector switch lever forwardly or backwardly. The direction of movement or the position of the selector switch lever 22 corresponds thereby to the main direction of travel of the ship. The preselection is done by a cam 27 operating one of two selector switches 28, 29. The selector switches report the desired direction of travel to the control device 18. The selector switch lever 22 also operates a clutch cam 30, which acts onto a clutch switch 31, which switches the clutch 6 through the control device.

In addition, the selector switch lever 22 operates a sliding potentiometer 32 which presupposes the desired rotational speed of the motor 7 indicated on the tachometer 33—carburetor, fuel pump or the like—through the control device 18. The rotational speed is chosen through a follower control device which is stored in the said control device 18.

The arrangement is such that at a vertical position of the selector switch lever 22, the speed of the motor 7 is switched to idling. The clutch cam 30 has then switched off the clutch 6 through the clutch operator 31. If the selector switch lever 22 is displaced forwardly, then the desired direction of travel is reported to the control device 18 through the cam 27 and selector switch 29. Various switching operations are then carried out simultaneously in the control device 18. The potentiometers 10 to 13 which are decisive for the desired direction of travel are switched first to the direction of travel indicator 20 and the reference element 25 indicative of the rudder position through a relay 34. This is done by connecting a line or wire 35 which comes from the direction of travel indicator 20 and the line coming from the reference element 25 by the said relay to the corresponding lines 14 to 17. If the desired direction of travel does not correspond with the steerable propeller position, then the hydraulic aggregate 5 is switched on by the control device 18.

Aside from the above listed elements for the common rudder position control, a hydraulic accumulator 50 which functions as an energy storage device is also provided in or on the hydraulic aggregate. Such hydraulic accumulators are actually known, so that it does not need to be described in detail. The energy which is stored in the hydraulic accumulator is switched to the pump output only when a change in the main direction of travel is presupposed. Because of the control power which is needed only for a short time, it is possible to swivel the underwater part of the steerable propeller very quickly in this manner. A limitation of the 180°-rotation takes place through the connecting bridge of the potentiometers 25 and 10, or 15 and 11. The branch line 36 which branches off from the aforementioned line 26 and extends to the control device 18 assures that the constant comparison between the desired value and the actual value of the potentiometers is carried out by the control device 18.

If the selector switch lever 22 is swung on, then the clutch cam 30 releases the clutch operator 31 and the clutch 6 is switched on. Upon further swinging of the selector switch lever 22, the sliding potentiometer 32 elongates or is pulled apart and results in an increase of the speed of the motor.

To reverse the main direction of travel, the selector switch lever 22 is pulled back. The speed of the motor is thereby first lowered, then the clutch 6 is uncoupled and thus the thrust of the propeller is eliminated. Upon a further backward movement of the selector switch lever 22, the cam 27 switches on the switch 28 and therewith presupposes in the control device 18 the main direction of backward travel. The control device 18 reacts accordingly by energizing the relay 34 to effect a switching of the contacts on one set of potentiometers usable for one direction of travel to contacts on another set of potentiometers usable for the reverse direction of travel and a switching on of the hydraulic switch. The underwater part of the steerable propeller is swung 180°. Since during the change of the main direction of travel the direction of travel indicators and the rudder position reverse the polarity, the direction of travel always takes place in a direction corresponding to the position of the hand wheel for the rudder. This means if the hand wheel 21 for the rudder is rotatable to the right, then the direction of travel of the ship always changes to the right, regardless of whether one looks over bow or rear. The direction of travel indication coincides correspondingly also always in the direction with the rudder and the direction of travel of the ship.

The direction of travel indicator 20 which is shown in FIG. 1 does not rotate the indicator backward, when the main direction of travel is switched to reverse, but the indicator indicates during reverse travel only the tendency right or left. Basically, it is of course also possible to switch to a second device during reverse travel, the indicator of which second device stays on reverse, or to use a device which permits an all around 360° indication.

Electronic structural elements are preferably used for the control device 18, which structural elements are known. It is therefore sufficient, to presuppose the desired function. It is not necessary, however, to describe the switching circuit of the control device 18 in detail.

Figure 2:
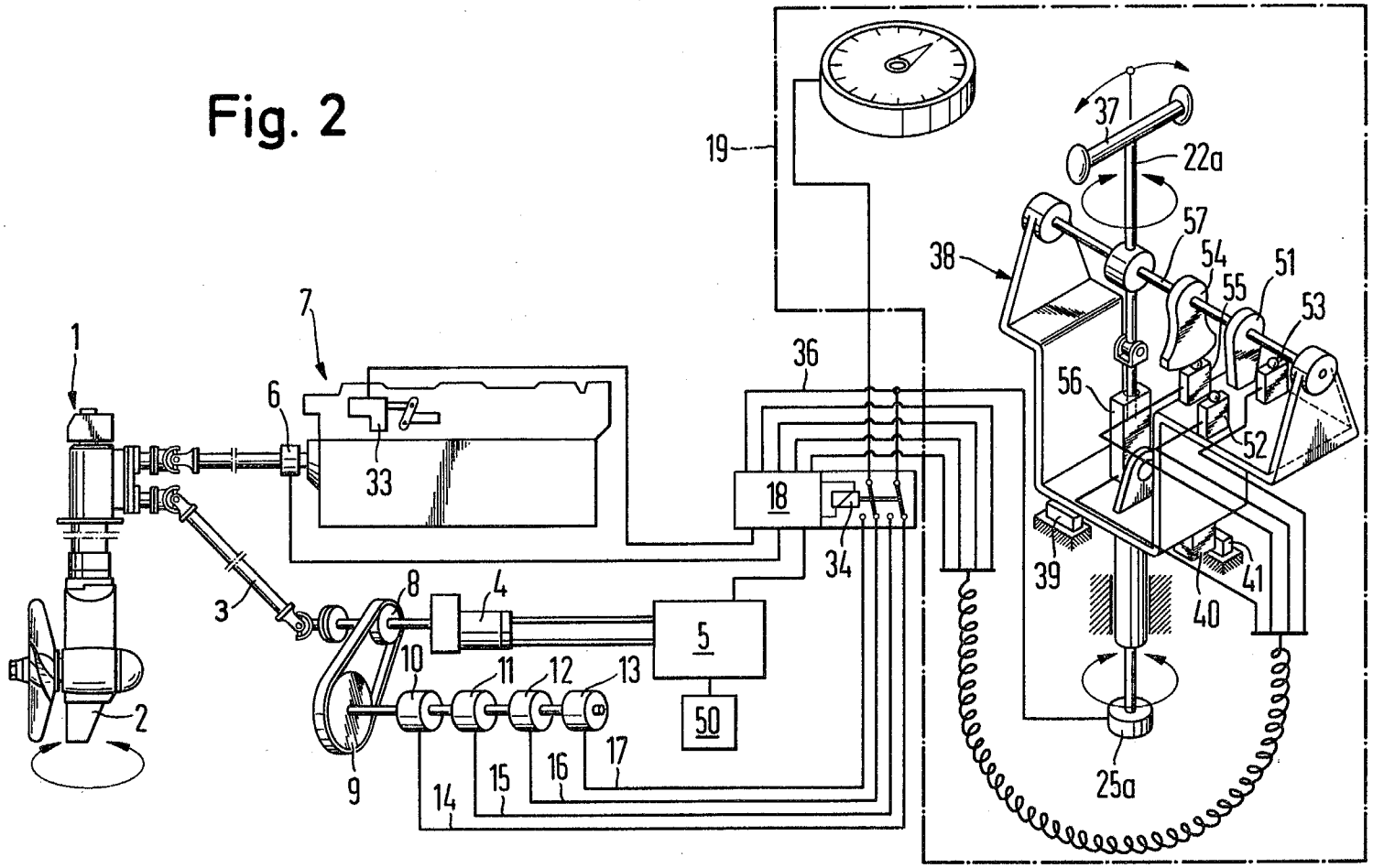
FIG. 2 illustrates a reversing mechanism with a single lever control.

FIG. 2 illustrates an embodiment of the invention, in which the function of the hand wheel for the steering control is combined with the selector switch lever 22*a*. The cams 51 and the selector switches 52, 53 which report the main direction of travel to the control device 18, the clutch cam 54 with the clutch switch 55 for the clutch 6 and the sliding potentiometer 56 for the speed control of the motor are secured on a carrier 38 which is pivotally supported for movement at 180° about a vertical axis. The swiveling movement is limited by a stop 40 and counter stops 39, 41. The swiveling movement is carried out through a control lever 37 and is reported by the potentiometer 25*a* to indicate the direction of travel of the control device 5. The selector switch lever 22*a* is pivotally supported for movement to the front and rear with the aforementioned cams 51, 54 in the carrier 38 by means of a horizontal shaft 57, it presupposes therewith the main direction of travel. The switching sequence corresponds to the description which has been given in connection with FIG. 1.

Figure 3:
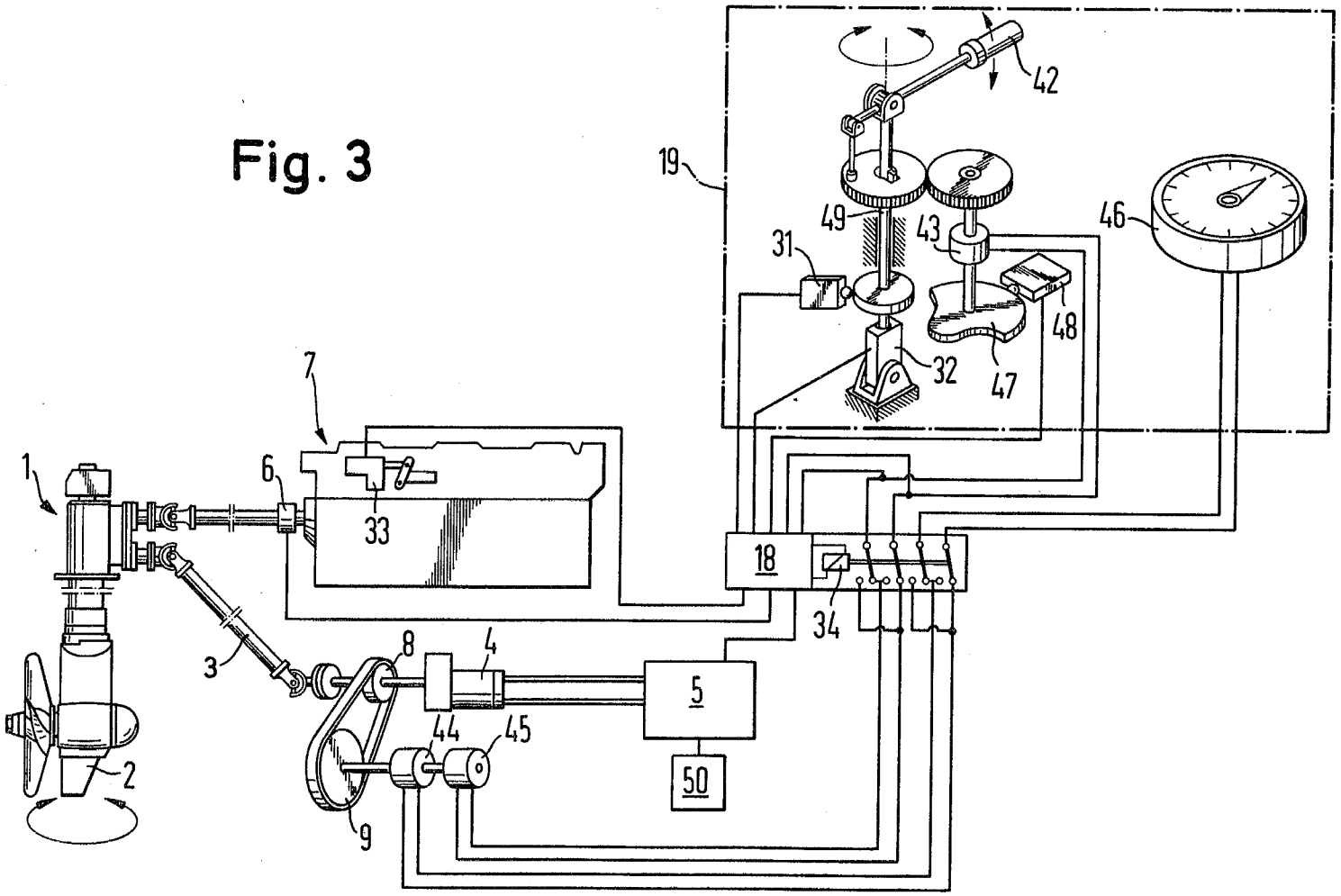
FIG. 3 illustrates a further embodiment according to the invention.

FIG. 3 illustrates an embodiment of the invention in which a control lever 42 is pivotally arranged for movement about a horizontal axis at an angle of 90°. With this swiveling or pivotal movement a rod 49, which is rotatably and longitudinally movably supported in a vertical bearing, is moved up or down and therewith the clutch switch 31 and the sliding potentiometer 32 for the speed control is operated. Upon rotation about the vertical axis, the rotation signal generator 43 (desired value) is rotated and therewith the desired direction of travel is indicated. The rudder position is scanned through rotation signal generators 44, 45 (actual value) and is compared with the position of the rotation signal generator 43 (desired value) or is reported to the direction of travel indicator 46. The main direction of travel is controlled by a selector switch cam 47 and selector switch 48.

A rotation of the control lever 42 about the vertical axis of the rod 49 effects through the selector switch cam 47 and the selector switch 48, an automatic reduction of the speed of the motor, which clutch is uncoupled and the steerable propeller is swung at 180° at a high speed. Subsequently the clutch is automatically again switched on and the speed is again driven up to the desired value. Furthermore reversing the polarity between the rotation signal generators 43, 44, 45 and the direction of travel indicator is carried out. The exemplary embodiment does not use, differing from the above examples, potentiometers for the actual value-desired value comparison but rotation signal generators (transmitters). Rotation signals operate both according to the direct current and also according to the alternating current principle. They are common in commerce and therefore do not need to be described in more detail (suppliers for example the Firm Hagenuk, Kiel; VDO, Tachometer Werke, Frankfurt; Simmonds Precision, Rockingham Road, Bellows Falls, Vt. 05101).

Figure 4:
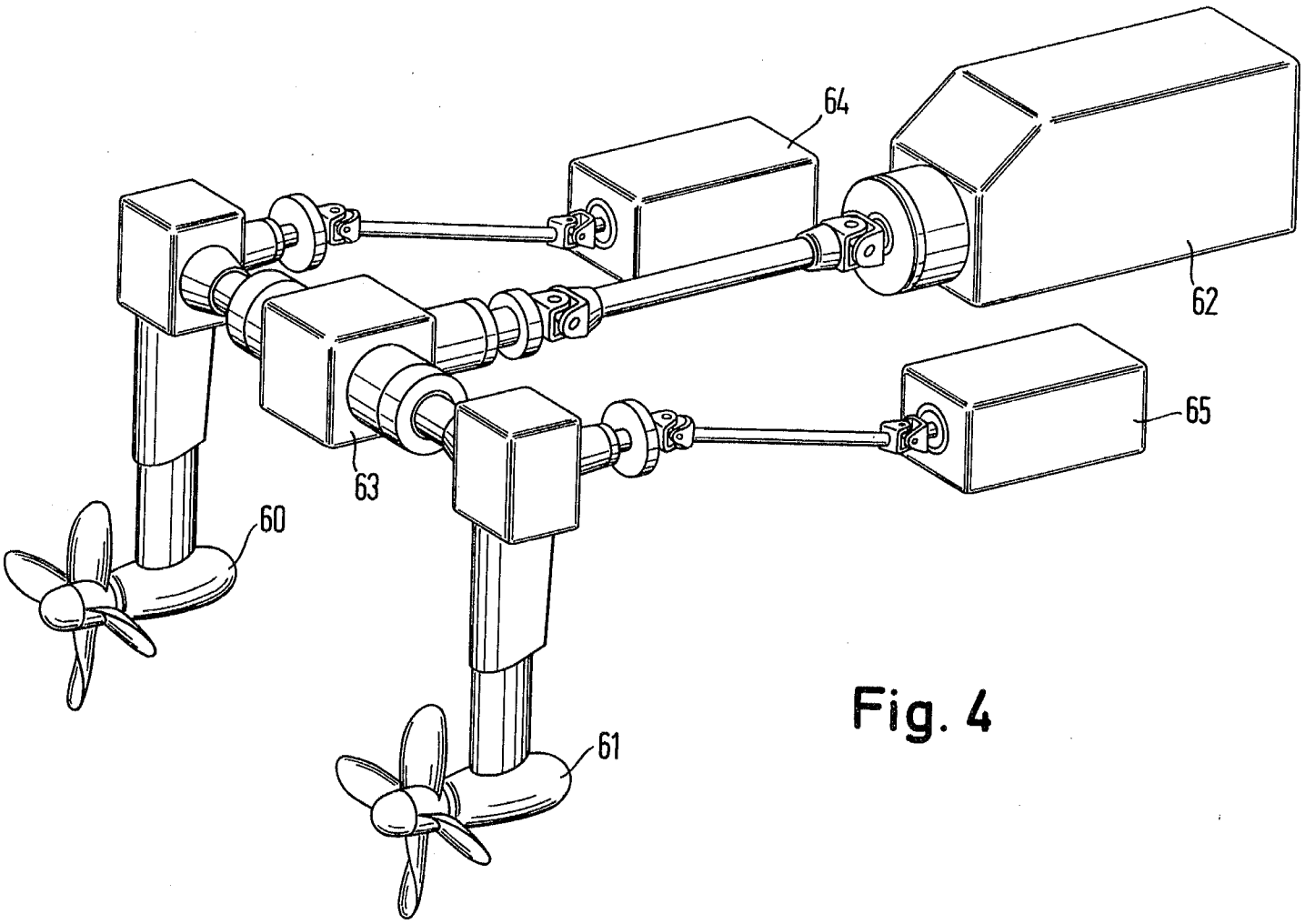
FIG. 4 illustrates the use of the invention on a steerable propeller double unit.

FIG. 4 illustrates the use of the invention on a double unit for steerable propellers. The two steerable propellers 60, 61 are driven from the drive mechanism 62 through branching gearing 63 in a conventional manner. A hydraulic motor 64, 65 is provided for each steerable propeller for driving its swiveling movement. The reversing mechanism corresponds accordingly to the aforementioned exemplary embodiments. Attention must be directioned to the direction of swing of the propellers so that for the normal control of the ship, the underwater parts of the steerable propellers are swung or pivoted synchronously, while for the reversal swing to a different main direction of travel the underwater parts are oppositely directed. In this case of use, the advantage of the invention is particularly noticeable.

Electronically hydraulic control systems are described for the exemplary embodiments. Naturally it is also possible to build mechanical-hydraulic or mechanical-electrical control systems, which correspond to the invention. The selector switch for the turning control signal of the main direction of travel switches then utilizes corresponding gearings or clutches and effects therewith a quick reversing of the steerable propeller at 180° and a reversal between the steerable propeller and the direction of travel indication.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A control device for controlling the direction of applied thrust from a steerable drive means rotatably supported on a watercraft for 360° movement about a vertical axis, said watercraft including drive means thereon for generating said applied thrust, said control device comprising:

drive transmitting means connected to said steerable drive means for selectively driving said steerable drive means about said vertical axis;

steering control means operatively connected to said drive transmitting means for steering the direction of applied thrust through a first range of movement of about 180° limited to within about ±90° swing from the longitudinal axis of said watercraft and with said range orientable either forward or rearward of said vertical axis; and reversing control means movable between two areas, said reversing control means being operatively connected to said drive transmitting means only in response to location thereof in either one of said two areas location in either one of said two areas effecting, independent of said steering control means, through said drive transmitting means a one-step movement of said steerable drive means about said vertical axis completely through a second range of movement of 180° at a speed higher than providable by said steering control means.

2. A control device according to claim 1, wherein said steering control means includes a first manually engageable control member and first means for transmitting the movement of said first control member to said drive transmitting means for controlling the direction of travel of said watercraft; and wherein said reversing control means includes a second manually engageable control member which is separate from said first control member and is movable between said two areas, and second means responsive to a movement of said second control member to either one of said two areas for effecting the rapid and continuous movement of said steerable drive means through said second range thereby reversing the direction of applied thrust.

3. A control device according to claim 1, wherein said steering control means and said reversing control means include a common manually engageable control member supported for movement in two planes and which, when moved in one plane, effects a control of said drive transmitting means and the direction of travel of said watercraft without a net rearward component of applied thrust at said vertical axis and, when moved in the other plane to one of said said two areas effects said reversing of the direction of applied thrust and prevents generating of any net forward component of applied thrust by subsequent movement in said one plane.

4. A control device according to claim 1, wherein said drive transmitting means includes energy storage means responsive to an actuation of said reversing control means for effecting an accelerated movement of said steerable drive means through said second range of movement.

5. A control device according to claim 4, wherein said drive transmitting means further includes a hydraulic motor and supply means for supplying hydraulic fluid to said hydraulic motor, said hydraulic motor having a rotary output member and torque transfer means for transferring the torque output of said hydraulic motor to said steerable drive means.

6. A control device according to claim 5, wherein said energy storage means comprises a hydraulic fluid accumulator means for storing hydraulic fluid under pressure, which fluid when released effects a greater than normal surge of hydraulic fluid to said hydraulic motor to effect the rapid movement of said steerable drive means within said second range of movement.

7. A control device according to claim 1, wherein said steering control means includes a manually engageable control member for controlling the direction of travel of said watercraft; and wherein said steering control means further includes means for transmitting the movement of said control member to said drive transmitting means, said drive transmitting means including an indicator device and servo means responsive to the direction of said applied thrust for producing an output signal to said indicator device to indicate to said operator said direction of applied thrust.

8. A control device according to claim 1, wherein said steerable drive means includes an underwater part and a rotatably supported propeller, said drive means being connected by drive train means to said propeller with a clutch mechanism connected in said drive train means between said drive means and said propeller; and wherein said reversing control means includes clutch control means responsive to the position of said reversing control means to effect a control of the condition of said clutch mechanism, said reversing control means including a throttle control device on said drive means responsive to the position of said reversing control means to effect a control of the speed of said drive means.

9. A control device according to claim 1, wherein said watercraft has plural steerable drive means; and wherein said reversing control means includes plural drive transmitting means for effecting a simultaneous reversing of said direction of applied thrust of each of said plural steerable drive means.

10. A control device according to claim 1, wherein said first range of movement of said applied thrust controlled by said steering control means is 180° limited by said lines which extend perpendicularly to the longitudinal axis of said watercraft and intersecting said vertical axis.

11. A control device for controlling the thrust direction of one steerable thrust producer rotatably supported on a watercraft for 360° movement about a vertical axis, said watercraft including drive means thereon for powering said thrust producer, said control device comprising:

thrust control means for increasing and reducing said power supplied by said drive means to said thrust producer;

steering transmitting means connected to said steerable thrust producer for selectively rotating said steerable thrust producer about said vertical axis;

steering control means including a proportional displacement-to-signal transducer operatively connected to said steering transmitting means for rotating the direction of thrust of said thrust producer at a steering speed incrementally and back and forth only within a first range of arcuate movement about 180°, said first range being measured between opposite lateral sides of said vertical axis with the direction of thrust of said thrust producer kept aimed rearwardly of lines extending substantially perpendicular to the longitudinal axis of said watercraft and intersecting said vertical axis, said steering control means including a manual steering member manually engaged for actuating said proportional transducer for steering of said watercraft by a helmsman, said manual steering member being movable by the helmsman incrementally to proportionally move said steerable thrust producer within said first range of about 180°, and means positively preventing movement of said steerable thrust producer beyond the ends of said first range of about 180° in proportional response to movement of a manually actuated member;

reversing control means including a reversing switch operatively connected to said steering transmitting means and actuatable only for effecting a continuous one-step rotation of said steerable thrust producer about said vertical axis at a speed more rapid than said steering speed completely through a 180° second range of arcuate movement without a corresponding proportional movement of any manually actuated member, said second range being measured from a line in said direction of thrust at the time said direction of thrust is to be reversed, said reversing control means further including a switch actuator manually operable by the helmsman for nonproportionally actuating said reversing switch when the helmsman desires that the watercraft be propelled rearwardly rather than forwardly, said first range having only two alternatively selectable orientations which orientations are first with said thrust producer kept aimed rearwardly of said lines extending substantially perpendicular to said longitudinal axis and second with said thrust producer kept aimed forwardly of said lines, said reversing switch actuation effectively placing said first range in its second orientation;

an energy storage means connectable to said steering transmitting means in response to said actuation of said reversing switch to achieve said more rapid speed in said continuous one-step rotation of said steerable thrust producer completely through said 180° second range; and means also actuated by said means actuator by its actuation of said reversing switch for preventing said drive means from powering said thrust producer during said continuous one-step rotation of the latter through said second range of movement, and thereby preventing said one thrust producer from unwanted pushing of said watercraft sideways while shifting said thrust producer between forward and rearward thrust positions.

* * * * *

UNITED STATES PATENT OFFICE

CERTIFICATE OF CORRECTION

Patent No. 4 334 489 Dated June 15, 1982

Inventor(s) Kurt Seitzinger and Siegfried Lais

It is certified that error appears in the above-identified patent and that said Letters Patent are hereby corrected as shown below:

On the Title page,

[73] Assignee: delete the comma after "Co.".

Column 7, line 24; after "areas" (first occurrence) insert ---,---.

Column 10, line 18; change "said means actuator" to ---said switch actuator---.

Signed and Sealed this

Fifth Day of October 1982

[SEAL]

Attest:

GERALD J. MOSSINGHOFF

Attesting Officer

Commissioner of Patents and Trademarks